US009620061B2

(12) United States Patent
Cao et al.

(10) Patent No.: US 9,620,061 B2
(45) Date of Patent: Apr. 11, 2017

(54) GATE DRIVER CIRCUIT, GATE DRIVING METHOD, GATE-ON-ARRAY CIRCUIT, DISPLAY DEVICE, AND ELECTRONIC PRODUCT

(71) Applicant: BOE TECHNOLOGY GROUP CO., LTD., Beijing (CN)

(72) Inventors: Kun Cao, Beijing (CN); Zhongyuan Wu, Beijing (CN); Liye Duan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 117 days.

(21) Appl. No.: 14/415,701

(22) PCT Filed: Apr. 25, 2014

(86) PCT No.: PCT/CN2014/076258

§ 371 (c)(1),
(2) Date: Jan. 19, 2015

(87) PCT Pub. No.: WO2015/100889

PCT Pub. Date: Jul. 9, 2015

(65) Prior Publication Data

US 2016/0049116 A1 Feb. 18, 2016

(30) Foreign Application Priority Data

Dec. 30, 2013 (CN) ..... 2013 1 0745360

(51) Int. Cl.
*G09G 3/32* (2016.01)
*G09G 3/3258* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3233; G09G 3/3266; G09G 2310/08; G09G 2310/0262;
(Continued)

(56) References Cited

U.S. PATENT DOCUMENTS 7,382,347 B2 6/2008 Sasaki et al.
7,605,789 B2 10/2009 Uchino et al.
(Continued)

FOREIGN PATENT DOCUMENTS

CN 1684558 A 10/2005
CN 101097677 A 1/2008
(Continued)

OTHER PUBLICATIONS

Office Action of Chinese application No. 201310745360.X, dated Jul. 30, 2015.
(Continued)

*Primary Examiner* — Christopher E Leiby
(74) *Attorney, Agent, or Firm* — Harness, Dickey & Pierce, P.L.C.

(57) ABSTRACT

The gate driver circuit is connected to a row of pixel units, each pixel unit includes a pixel driving module and a light-emitting device connected to each other, the pixel driving module including a driving transistor, a driving module and a compensating module, the compensating module being connected to a gate scanning signal, and the driving module being connected to a driving control signal and a driving voltage. The gate driver circuit includes a row pixel controlling unit configured to provide the gate scanning signal to the compensating module and provide the driving voltage to the driving module, so as to control the compensating module to compensate for a threshold voltage of the driving transistor; and a driving control unit configured to provide the driving control signal to the driving module so as to control the driving module to drive the light-emitting device.

16 Claims, 6 Drawing Sheets

(51) Int. Cl.
*G09G 3/3233* (2016.01)
*G09G 3/3266* (2016.01)

(52) U.S. Cl.
CPC ..... *G09G 2300/0819* (2013.01); *G09G 2300/0852* (2013.01); *G09G 2300/0861* (2013.01); *G09G 2300/0866* (2013.01); *G09G 2310/0262* (2013.01); *G09G 2310/0286* (2013.01); *G09G 2310/0289* (2013.01); *G09G 2310/08* (2013.01); *G09G 2320/043* (2013.01)

(58) Field of Classification Search
CPC ... G09G 2310/0286; G09G 2310/0289; G09G 2300/0819; G09G 2300/0861; G09G 2300/0866; G09G 2300/0852; G09G 2320/043
See application file for complete search history.

(56) References Cited

U.S. PATENT DOCUMENTS 8,289,261 B2* 10/2012 Lee ..... G09G 3/3266 324/333
2006/0038500 A1* 2/2006 Lee ..... H01L 29/42384 315/169.1
2006/0202977 A1 9/2006 Oh
2006/0269038 A1* 11/2006 Jang ..... G11C 19/287 377/64
2006/0291610 A1 12/2006 Lo et al.
2007/0091029 A1 4/2007 Uchino et al.
2007/0296662 A1* 12/2007 Lee ..... G09G 3/3677 345/87
2009/0122951 A1* 5/2009 Tobita ..... G11C 19/28 377/68
2009/0135166 A1 5/2009 Uchino et al.
2010/0134469 A1 6/2010 Ogura et al.
2010/0182227 A1* 7/2010 Tsou ..... G09G 3/3677 345/100
2010/0188385 A1 7/2010 Boiko
2010/0201659 A1* 8/2010 Miyake ..... G09G 3/3677 345/205
2010/0207667 A1* 8/2010 Kwon ..... G09G 3/3674 327/108
2011/0058640 A1* 3/2011 Shang ..... G11C 19/184 377/64
2011/0157112 A1 6/2011 Shibata et al.
2011/0164071 A1 7/2011 Chung et al.
2011/0279429 A1* 11/2011 Kim ..... G09G 3/3674 345/211
2012/0113088 A1* 5/2012 Han ..... G09G 3/3674 345/212
2012/0287103 A1 11/2012 Wu et al.
2013/0201172 A1* 8/2013 Jeong ..... G09G 3/3233 345/212
2013/0307840 A1 11/2013 Lee et al.
2014/0072093 A1* 3/2014 Shang ..... G09G 3/20 377/69
2014/0085285 A1 3/2014 Kim
2014/0119491 A1* 5/2014 Liu ..... G11C 19/28 377/64
2014/0168049 A1* 6/2014 Gu ..... G09G 3/3685 345/100
2014/0169518 A1* 6/2014 Kong ..... G09G 3/3674 377/64
2014/0176410 A1* 6/2014 Ma ..... G09G 3/3622 345/92
2014/0240209 A1* 8/2014 Zhang ..... G09G 3/3648 345/92
2015/0077319 A1* 3/2015 Yao ..... G09G 3/20 345/100
2016/0064098 A1* 3/2016 Han ..... G11C 19/28 345/211
2016/0111065 A1* 4/2016 Wang ..... G09G 3/3611 345/213

FOREIGN PATENT DOCUMENTS

CN 101122720 A 2/2008
CN 101183508 A 5/2008
CN 101271667 A 9/2008
CN 101276547 A 10/2008
CN 101339737 A 1/2009
CN 101364392 A 2/2009
CN 101556762 A 10/2009
CN 101556763 A 10/2009
CN 101770745 A 7/2010
CN 102298900 A 12/2011
CN 102592561 A 7/2012
CN 102654972 A 9/2012
CN 102708824 A 10/2012
CN 102930822 A 2/2013
CN 102956269 A 3/2013
CN 202917146 U 5/2013
CN 103218970 A 7/2013
CN 103236236 A 8/2013
CN 203179475 U 9/2013
CN 203179476 U 9/2013
CN 103440840 A 12/2013
CN 103714780 A 4/2014
CN 103714781 A 4/2014
CN 103730089 A 4/2014
EP 2237253 A1 10/2010
JP 2007140318 A 6/2007
KR 20060091465 A 8/2006

OTHER PUBLICATIONS

Written Opinion of the International Searching Authority for international application No. PCT/CN2014/076258.
International Search Report and Written Opinion dated Apr. 25, 2014 regarding PCT/CN2014/076258.
Chinese Office Action dated Mar. 30, 2015 regarding Chinese Application No. 201310745360.X. Translation provided by Dragon Intellectual Property Law Firm.
Chinese Office Action dated Sep. 12, 2014 regarding Application No. 201310745360.X, filed Dec. 30, 2013. Translation provided by Dragon Intellectual Property Law Firm.
First Office Action regarding Chinese Application No. 201310738811.7 dated May 6, 2015. Translation provided by Dragon Intellectual Property Law Firm.
First Office Action regarding Chinese Application No. 201310722407.0 dated Sep. 11, 2014. Translation provided by Dragon Intellectual Property Law Firm.
Second Office Action regarding Chinese Application No. 201310722407.0 dated Feb. 13, 2015. Translation provided by Dragon Intellectual Property Law Firm.
Written Opinion of the International Searching Authority regarding International Application No. PCT/CN2014/078725. Translation provided by Dragon Intellectual Property Law Firm.
Written Opinion of the International Searching Authority regarding International Application No. PCT/CN2014/076261. Translation provided by Dragon Intellectual Property Law Firm.

* cited by examiner

GATE DRIVER CIRCUIT, GATE DRIVING METHOD, GATE-ON-ARRAY CIRCUIT, DISPLAY DEVICE, AND ELECTRONIC PRODUCT

CROSS-REFERENCE TO RELATED APPLICATION

This application is the U.S. national phase of PCT Application No. PCT/CN2014/076258 filed on Apr. 25, 2014, which claims a priority of the Chinese patent application No. 201310745360.X filed on Dec. 30, 2013, which is incorporated herein by reference in its entirety.

TECHNICAL FIELD

The present disclosure relates to the field of display technology, in particular to a gate driver circuit, a gate driving method, a gate-on-array circuit, a display device and an electronic product.

BACKGROUND

Currently, in the prior art, there is no GOA (gate-on-array, which means that a gate driver circuit is directly formed on an array substrate) circuit capable of providing Vth (threshold voltage) compensation for a pixel of an OLED (organic light-emitting diode) display panel, and only a pixel design with a Vth compensation function or a single-pulse GOA circuit is applied.

Usually, an OLED pixel design of a current-controlled mode is adopted, so the display evenness of the OLED display panel will be reduced due to the uneven Vth of the entire OLED display panel and a Vth shift generated after the long-term operation. In order to enhance an integration level of the OLED display panel and reduce the production cost, the use of an integrated gate driver technology is a trend of development in future. However, a peripheral driver circuit is desired for the OLED Vth compensation pixel design, and as a result, more requirements are put forward on the GOA circuit.

SUMMARY

A main object of the present disclosure is to provide a gate driver circuit, a gate driving method, a GOA circuit, a display device, and an electronic device, so as to compensate for a threshold voltage of a pixel and drive the pixel simultaneously, thereby to improve an integration level.

In one aspect, the present disclosure provides a gate driver circuit connected to a row of pixel units, each pixel unit includes a pixel driving module and a light-emitting device connected to each other, the pixel driving module including a driving transistor, a driving module and a compensating module, the compensating module being connected to a gate scanning signal, and the driving module being connected to a driving control signal and a driving voltage, the gate driver circuit comprising: a row pixel controlling unit configured to provide the gate scanning signal to the compensating module and provide the driving voltage to the driving module, so as to control the compensating module to compensate for a threshold voltage of the driving transistor; and a driving control unit configured to provide the driving control signal to the driving module so as to control the driving module to drive the light-emitting device.

During the implementation, the row pixel controlling unit includes a start signal input end, a first control clock input end, a second control clock input end, a reset signal input end, an input clock end, a carry signal output end, a cut-off control signal output end, an output level end, an output level pull-down control end, a gate scanning signal output end.

The row pixel controlling unit further includes:

a first pull-up node potential pull-up module configured to pull up a potential of a first pull-up node to a high level when a first control clock signal and a first start signal are at a high level;

a first storage capacitor connected between the first pull-up node and the carry signal output end;

a first pull-up node potential pull-down module configured to pull down the potential of the first pull-up mode to a first low level when a potential of a first pull-down node or a second pull-down node is a high level;

a first control clock switch configured to enable the first control clock input end to be electrically connected to the first pull-down node when the first control clock signal is at a high level;

a second control clock switch configured to enable the second control clock input end to be electrically connected to the second pull-down node when a second control clock signal is at a high level;

a first pull-down node potential pull-down module configured to pull down the potential of the first pull-down node to the first low level when the potential of the first pull-up node or the second pull-down node is a high level;

a second pull-down node potential pull-down module connected to the reset signal input end and configured to pull down the potential of the second pull-down node to the first low level when the potential of the first pull-up node or the first pull-down node is a high level;

a first carry control module configured to enable the carry signal output end to be electrically connected to the second clock signal input end when the potential of the first pull-up node is a high level;

a first carry signal pull-down module configured to pull down a potential of a carry signal to the first low level when the potential of the first pull-down node or the second pull-down node is a high level;

a first cut-off control module configured to enable the second clock signal input end to be electrically connected to the cut-off control signal output end when the potential of the first pull-up node is a high level, and enable the cut-off control signal output end to be electrically connected to a second low level output end when the potential of the first pull-down node or the second pull-down node is a high level;

a first feedback module configured to transmit a cut-off control signal to the first pull-up node potential pull-up module and the first pull-up node potential pull-down module when the carry signal is at a high level;

a gate scanning signal control module configured to enable the second control clock input end to be electrically connected to the gate scanning signal output end when the potential of the first pull-up node is a high level;

an input clock switch configured to enable the input clock end to be electrically connected to the output level pull-down control end when the potential of the first pull-up node is a high level;

a gate scanning signal pull-down module configured to pull down a potential of the gate scanning signal to a second low level when the potential of the first pull-down node or the second pull-down node is a high level;

an output level pull-down control module configured to pull down a potential of the output level pull-down control end to the second low level when the potential of the first pull-down node or the second pull-down node is a high level;

an output level pull-up module configured to pull up an output level to a high level when the output level pull-down control end outputs the second low level; and an output level pull-down module configured to pull down the output level to the second low level when the output level pull-down control end outputs a high level.

During the implementation, the driving control unit includes: a second start signal input end, a third control clock input end, a fourth control clock input end, a driving control signal output end, and a driving control signal pull-down control end. The reset signal input end, the carry signal output end and the cut-off control signal output end are connected to the driving control unit.

The driving control unit further includes:

a second pull-up node potential pull-up module configured to pull up a potential of a second pull-up node to a high level when a third control clock signal and a second start signal are at a high level;

a second storage capacitor connected between the second pull-up node and the carry signal output end;

a second pull-up node potential pull-down module configured to pull down the potential of the second pull-up node to the first low level when the potential of the first pull-down node or the second pull-down node is a high level;

a third control clock switch configured to enable the third control clock input end to be electrically connected to a third pull-down node when the third control clock signal is at a high level;

a fourth control clock switch configured to enable the fourth control clock input end to be electrically connected to a fourth pull-down node when a fourth control clock signal is at a high level;

a third pull-down node potential pull-down module configured to pull down a potential of the third pull-down node to the first low level when the potential of the second pull-up node or a potential of the fourth pull-down node is a high level;

a fourth pull-down node potential pull-down module connected to the reset signal input end and configured to pull down the potential of the fourth pull-down node to the first low level when the potential of the second pull-up node or the third pull-down node is a high level;

a second carry control module configured to enable the carry signal output end to be electrically connected to the fourth control clock input end when the potential of the second pull-up node is a high level;

a second carry signal pull-down module configured to pull down the potential of the carry signal to the first low level when the potential of the third pull-down node or the fourth pull-down node is a high level;

a second cut-off control module configured to enable the fourth control clock input end to be electrically connected to the cut-off control signal output end when the potential of the second pull-up node is a high level, and enable the cut-off control signal output end to be electrically connected to the second low level output end when the potential of the third pull-down node or the fourth pull-down node is a high level;

a second feedback module configured to transmit the cut-off control signal to the second pull-up node potential pull-up module and the second pull-up node potential pull-down module when the carry signal is at a high level;

a driving control submodule configured to enable the fourth control clock input end to be electrically connected to the driving control signal pull-down control end when the potential of the second pull-up node is a high level;

a driving control signal pull-down control module configured to pull down a potential of the driving control signal pull-down control end to the second low level when the potential of the third pull-down node or the fourth pull-down node is a high level;

a driving control signal pull-up module configured to pull up a potential of the driving control signal to a high level when the driving control signal pull-down control end outputs a high level; and a driving control signal pull-down module configured to pull down the potential of the driving control signal to the second low level when the driving control signal pull-down control end outputs a high level.

During the implementation, the first pull-up node potential pull-up module includes:

a first pull-up node potential pull-up transistor, a gate electrode and a first electrode of which are connected to the first start signal input end, and a second electrode of which is connected to the first feedback module; and a second pull-up node potential pull-up transistor, a gate electrode of which is connected to the first control clock input end, a first electrode of which is connected to the second electrode of the first pull-up node potential pull-up transistor, and a second electrode of which is connected to the first pull-up node.

The first pull-up node potential pull-down module includes:

a first pull-up node potential pull-down transistor, a gate electrode of which is connected to the first pull-down node, a first electrode of which is connected to the first pull-up node, and a second electrode of which is connected to the first feedback module;

a second pull-up node potential pull-down transistor, a gate electrode of which is connected to the first pull-down node, a first electrode of which is connected to the second electrode of the first pull-up node potential pull-down transistor, and a second electrode of which is connected to the first low level;

a third pull-up node potential pull-down transistor, a gate electrode of which is connected to the second pull-down node, a first electrode of which is connected to the first pull-up node, and a second electrode of which is connected to the first feedback module; and a fourth pull-node potential pull-down transistor, a gate electrode of which is connected to the second pull-down node, a first electrode of which is connected to the second electrode of the third pull-up node potential pull-down transistor, and a second electrode of which is connected to the first low level.

The first pull-down node potential pull-down module includes:

a first pull-down transistor, a gate electrode of which is connected to the first pull-up node, a first electrode of which is connected to the first pull-down node, and a second electrode of which is connected to the reset signal input end;

a second pull-down transistor, a gate electrode of which is connected to the first pull-up node, a first electrode of which is connected to the second electrode of the first pull-down transistor, and a second electrode of which is connected to the first low level; and a third pull-down transistor, a gate electrode of which is connected to the second pull-down node, a first electrode of which is connected to the first pull-down node, and a second electrode of which is connected to the first low level.

The second pull-down node potential pull-down module includes:

a fourth pull-down transistor, a gate electrode of which is connected to the first pull-up node, a first electrode of which is connected to the second pull-down node, and a second electrode of which is connected to the reset signal input end;

a fifth pull-down transistor, a gate electrode of which is connected to the first pull-up node, a first electrode of which is connected to the second electrode of the fourth pull-down transistor, and a second electrode of which is connected to the first low level; and a sixth pull-down transistor, a gate electrode of which is connected to the first pull-down node, a first electrode of which is connected to the second pull-down node, and a second electrode of which is connected to the first low level.

During the implementation, the first carry control module includes:

a first carry control transistor, a gate electrode of which is connected to the first pull-up node, a first electrode of which is connected to the second control clock input end, and a second electrode of which is connected to the carry signal output end.

The first carry signal pull-down module includes:

a first carry signal pull-down transistor, a gate electrode of which is connected to the first pull-down node, a first electrode of which is connected to the carry signal output end, and a second electrode of which is connected to the first low level; and a second carry signal pull-down transistor, a gate electrode of which is connected to the second pull-down node, a first electrode of which is connected to the carry signal output end, and a second electrode of which is connected to the first low level.

The first cut-off control module includes:

a first cut-off control transistor, a gate electrode of which is connected to the first pull-up node, a first electrode of which is connected to the second control clock input end, and a second electrode of which is connected to the cut-off control signal output end;

a second cut-off control transistor, a gate electrode of which is connected to the first pull-down node, a first electrode of which is connected to the cut-off control signal output end, and a second electrode of which is connected to the first low level; and a third cut-off control transistor, a gate electrode of which is connected to the second pull-down node, a first electrode of which is connected to the cut-off control signal output end, and a second electrode of which is connected to the first low level.

The first feedback module includes:

a first feedback transistor, a gate electrode of which is connected to the carry signal output end, a first electrode of which is connected to the second electrode of the first pull-up node potential pull-up transistor, and a second electrode of which is connected to the cut-off control signal output end.

During the implementation, the gate scanning signal control module includes:

a gate scanning control transistor, a gate electrode of which is connected to the first pull-up node, a first electrode of which is connected to the second control clock signal, and a second electrode of which is connected to the gate scanning signal output end.

The gate scanning signal pull-down module includes:

a first output pull-down transistor, a gate electrode of which is connected to the first pull-down node, a first electrode of which is connected to the gate scanning signal output end, and a second electrode of which is connected to the second low level; and a second output pull-down transistor, a gate electrode of which is connected to the second pull-down node, a first electrode of which is connected to the gate scanning signal output end, and a second electrode of which is connected to the second low level.

The output level pull-up module includes:

an output level pull-up transistor, a gate electrode and a first electrode of which are connected to a high level, and a second electrode of which is connected to the output level end.

The output level pull-down control module includes:

a first pull-down control transistor, a gate electrode of which is connected to the first pull-down node, a first electrode of which is connected to the output level pull-down control end, and a second electrode of which is connected to the second low level; and a second pull-down control transistor, a gate electrode of which is connected to the second pull-down node, a first electrode of which is connected to the output level pull-down control end, and a second electrode of which is connected to the second low level.

The output level pull-down module includes:

an output level pull-down transistor, a gate electrode of which is connected to the output level pull-down control end, a first electrode of which is connected to the output level end, and a second electrode of which is connected to the second low level.

During the implementation, the second pull-up node potential pull-up module includes:

a third pull-up node potential pull-up transistor, a gate electrode and a first electrode of which are connected to the second start signal input end, and a second electrode of which is connected to the second feedback module; and a fourth pull-up node potential pull-up transistor, a gate electrode of which is connected to the third control clock input end, a first electrode of which is connected to the second electrode of the third pull-up node potential pull-up transistor, and a second electrode of which is connected to the second pull-up node.

The second pull-up node potential pull-down module includes:

a fifth pull-up node potential pull-down transistor, a gate electrode of which is connected to the third pull-down node, a first electrode of which is connected to the second pull-up node, and a second electrode of which is connected to the second feedback module;

a sixth pull-up node potential pull-down transistor, a gate electrode of which is connected to the third pull-down node, a first electrode of which is connected to the second electrode of the fifth pull-up node potential pull-down transistor, and a second electrode of which is connected to the first low level;

a seventh pull-up node potential pull-down transistor, a gate electrode of which is connected to the fourth pull-down node, a first electrode of which is connected to the second pull-up node, and a second electrode of which is connected to the second feedback module; and an eighth pull-up node potential pull-down transistor, a gate electrode of which is connected to the fourth pull-down node, a first electrode of which is connected to the second electrode of the seventh pull-up node potential pull-down transistor, and a second electrode of which is connected to the first low level.

The third pull-down node potential pull-down module includes:

a seventh pull-down transistor, a gate electrode of which is connected to the second pull-up node, a first electrode of which is connected to the third pull-down node, and a second electrode of which is connected to the reset signal input end;

an eighth pull-down transistor, a gate electrode of which is connected to the second pull-up node, a first electrode of which is connected to the second electrode of the seventh pull-down transistor, and a second electrode of which is connected to the first low level; and a ninth pull-down transistor, a gate electrode of which is connected to the fourth pull-down node, a first electrode of which is connected to the third pull-down node, and a second electrode of which is connected to the first low level.

The fourth pull-down node potential pull-down module includes:

a tenth pull-down transistor, a gate electrode of which is connected to the second pull-up node, a first electrode of which is connected to the fourth pull-down node, and a second electrode of which is connected to the reset signal input end;

an eleventh pull-down transistor, a gate electrode of which is connected to the second pull-up node, a first electrode of which is connected to the second electrode of the tenth pull-down transistor, and a second electrode is connected to the first low level; and a twelfth pull-down transistor, a gate electrode of which is connected to the third pull-down node, a first electrode of which is connected to the fourth pull-down node, and a second electrode of which is connected to the first low level.

During the implementation, the second carry control module includes:

a second carry control transistor, a gate electrode of which is connected to the second pull-up node, a first electrode of which is connected to the fourth control clock input end, and a second electrode of which is connected to the carry signal output end.

The second carry signal pull-down module includes:

a third carry signal pull-down transistor, a gate electrode of which is connected to the third pull-down node, a first electrode of which is connected to the carry signal output end, and a second electrode of which is connected to the first low level; and a fourth carry signal pull-down transistor, a gate electrode of which is connected to the fourth pull-down node, a first electrode of which is connected to the carry signal output end, and a second electrode of which is connected to the first low level.

The second cut-off control module includes:

a fourth cut-off control transistor, a gate electrode of which is connected to the second pull-up node, a first electrode of which is connected to the fourth control clock input end, and a second electrode of which is connected to the cut-off control signal output end;

a fifth cut-off control transistor, a gate electrode of which is connected to the third pull-down node, a first electrode of which is connected to the cut-off control signal output end, and a second electrode of which is connected to the first low level; and a sixth cut-off control transistor, a gate electrode of which is connected to the fourth pull-down node, a first electrode of which is connected to the cut-off control signal output end, and a second electrode of which is connected to the first low level.

The second feedback module includes:

a second feedback transistor, a gate electrode of which is connected to the carry signal output end, a first electrode of which is connected to the second electrode of the third pull-up node potential pull-up transistor, and a second electrode of which is connected to the cut-off control signal output end.

During the implementation, the driving control submodule includes a driving control transistor, a gate electrode of which is connected to the second pull-up node, a first electrode of which is connected to the fourth control clock input end, and a second electrode of which is connected to the driving control signal pull-down control end.

The driving control signal pull-up module includes:

a driving control pull-up transistor, a gate electrode and a first electrode of which are connected to a high level, and a second electrode of which is connected to the driving control signal output end.

The driving control signal pull-down control module includes:

a first driving pull-down control transistor, a gate electrode of which is connected to the third pull-down node, a first electrode of which is connected to the driving control signal pull-down control end, and a second electrode of which is connected to the second low level; and a second driving pull-down control transistor, a gate electrode of which is connected to the fourth pull-down node, a first electrode of which is connected to the driving control signal pull-down control end, and a second electrode of which is connected to the second low level.

The driving control signal pull-down module includes:

a driving pull-down transistor, a gate electrode of which is connected to the driving control signal pull-down control end, a first electrode of which is connected to the driving control signal output end, and a second electrode of which is connected to the second low level.

During the implementation, the first control clock signal is of a phase reverse to a phase of the second control clock signal, and duty ratios of the first control clock signal, the second control clock signal and the first start signal are all 0.5. The third control clock signal is of a phase reverse to a phase of the fourth control clock signal, and duty ratios of the third control clock signal, the fourth control clock signal and the second start signal are all less than 0.5.

In another aspect, the present disclosure provides a gate driving method for use in the above-mentioned gate driver circuit, including:

within a clock cycle after a first start signal input end inputs a high level, outputting, by a gate scanning signal output end, a high level, and a phase of an output signal from an output level end being reverse to a phase of an input clock signal; and within a clock cycle after a second start signal input end inputs a high level, a phase of a driving control signal being reverse to a phase of a second start signal.

In yet another aspect, the present disclosure provides a GOA circuit including multiple levels of the above-mentioned gate driver circuits. Apart from a first-level gate driver circuit, a cut-off control signal output end of each level of gate driver circuit is connected to a reset signal input end of a previous-level gate driver circuit, and apart from a last-level gate driver circuit, a carry signal output end of each level of gate driver circuit is connected to a first start signal input end of a next-level gate driver circuit.

During the implementation, the input clock signal inputted to an $(n+1)^{th}$-level gate driver circuit is of a phase reverse to a phase of the input clock signal inputted to an $n^{th}$-level gate driver circuit. N is an integer greater than or equal to 1, and (n+1) is less than or equal to the number of levels of the gate driver circuits included in the GOA circuit.

In still yet another aspect, the present disclosure provides a display device including the above-mentioned gate driver circuit.

During the implementation, the display device is an OLED display device or a low temperature poly-silicon (LTPS) display device.

In still yet another aspect, the present disclosure provides an electronic product including the above-mentioned display device.

As compared with the prior art, according to the gate driver circuit, the gate driving method, the GOA circuit, the display device and the electronic device of the present disclosure, the row pixel controlling unit is configured to provide the gate scanning signal to the compensating module and provide the driving voltage to the driving module, so as to control the compensating module to compensate for the threshold voltage of the driving transistor. In addition, the driving control unit is configured to provide the driving control signal to the driving module, so as to control the driving module to drive the light-emitting device. As a result, it is able to compensate for the pixel threshold voltage and drive the pixel simultaneously. In addition, by applying the gate driver circuit and the GOA circuit of the present disclosure to an OLED display panel, it is able to improve the integration level of the OLED display panel, thereby to reduce the protection cost.

DETAILED DESCRIPTION

A gate driver circuit of the present disclosure is connected to a row of pixel units, each pixel unitincludes a pixel driving module and a light-emitting device connected to each other. The pixel driving module includes a driving transistor, a driving module and a compensating module, the compensating module is connected to a gate scanning signal, and the driving module is connected to a driving control signal and a driving voltage.

The gate driver circuit includes a row pixel controlling unit configured to provide the gate scanning signal to the compensating module and provide the driving voltage to the driving module, so as to control the compensating module to compensate for a threshold voltage of the driving transistor; and a driving control unit configured to provide the driving control signal to the driving module so as to control the driving module to drive the light-emitting device.

According to the gate driver circuit of the present disclosure, the row pixel controlling unit is configured to provide the gate scanning signal to the compensating module and provide the driving voltage to the driving module, so as to control the compensating module to compensate for the threshold voltage of the driving transistor. In addition, the driving control unit is configured to provide the driving control signal to the driving module, so as to control the driving module to drive the light-emitting device. As a result, the gate driver circuit capable of compensating for the pixel threshold voltage is obtained.

The gate driver circuit of the present disclosure may be applied to an OLED display panel, so as to improve an integration level of the OLED display panel, thereby to reduce the production cost.

Figure 1A:
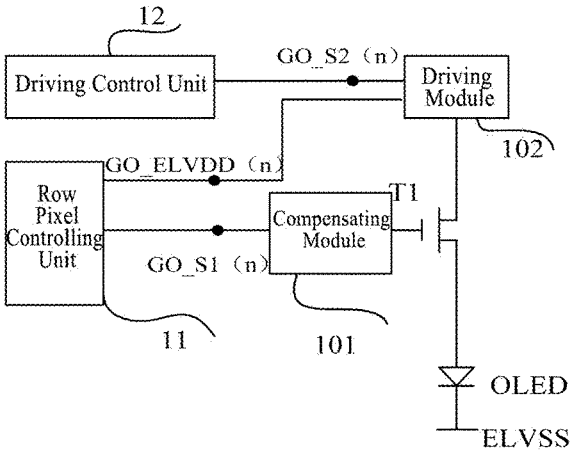
FIG. 1A is a schematic view showing the connection of a gate driver circuit and a pixel unit according to one embodiment of the present disclosure.

As shown in FIG. 1A, each pixel unit includes a pixel driving module and an OLED connected to each other. A cathode of the OLED is connected to a low level ELVSS. The pixel driving module includes a driving transistor T1, a driving module 102, and a compensating module 101. The compensating module 101 is connected to a gate scanning signal GO_S1 (*n*), and the driving module 102 is connected to a driving control signal GO_S2 (*n*) and a driving voltage GO_ELVDD (n). The gate driver circuit includes a row pixel controlling unit 11 configured to provide the gate scanning signal GO_S1 (*n*) to the compensating module 101 and provide the driving voltage GO_ELVDD (n) to the driving module 102, so as to control the compensating module 101 to compensate for a threshold voltage of the driving transistor T1; and a driving control unit 12 configured to provide the driving control signal GO_S2 (*n*) to the driving module 102 so as to control the driving module 102 to drive the OLED.

Figure 1B:
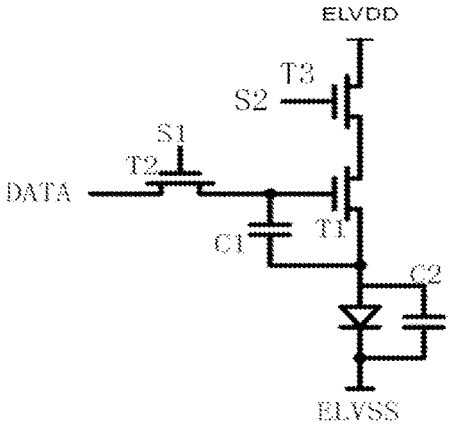
FIG. 1B is a circuit diagram of a pixel driving module of the pixel unit connected to the gate driver circuit according to one embodiment of the present disclosure.

As shown in FIG. 1B, the pixel driving module according to one embodiment includes the driving transistor T1, a compensating transistor T2, a driving control transistor T3, a first capacitor C1 and a second capacitor C2. T2 is included in the compensating module, and T3 is included in a driving control module. A gate electrode of T2 is connected to a gate scanning signal S1, a second electrode of T2 is connected to a data signal DATA, a gate electrode of T3 is connected to a driving control signal S2, a first electrode of T3 is connected to an output level ELVDD, and a cathode of the OLED is connected to a level ELVSS.

Figure 1C:
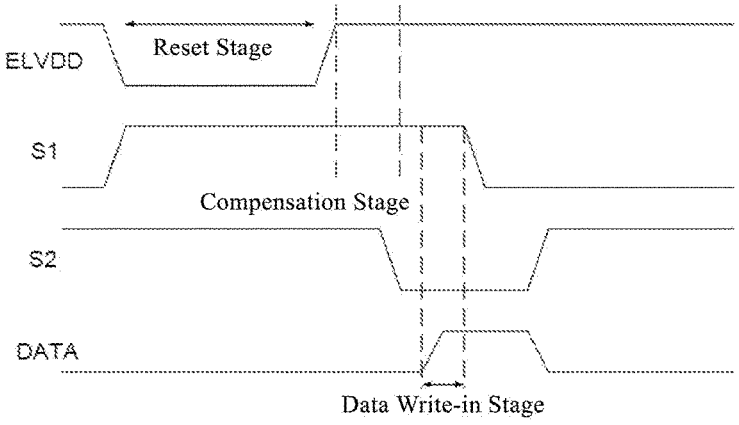
FIG. 1C is an operation sequence diagram of the pixel driving module in FIG. 1B.

FIG. 1C is an operation sequence diagram of the pixel driving module in FIG. 1B.

The present disclosure provides a GOA unit capable of cooperating with a Vth (threshold) compensation pixel design. The GOA unit can output two signals, one of which is a high-level pulse signal that may serve as the gate scanning signal (e.g., S1 in FIG. 1), and the other of which is a low-level pulse signal that may serve as ELVDD (as shown in FIG. 1A). Taking a commonly-used 3T2C threshold-compensated OLED pixel as an example, in order to drive the pixel, a low-level pulse signal S2 is further desired so as to control the signal ELVDD. In a GOA circuit, the low-level pulse signal S2 in an $n^{th}$ row may be used as the signal ELVDD in an $(n+1)^{th}$ row. By adjusting the sequence of the start signals and the clock signals, it is able to compensate for the threshold of the pixel and drive the pixel.

The gate driver circuit in this embodiment includes two portions, i.e., a left portion and a right portion, with respect to a display region of a panel. The row pixel controlling unit arranged on the left can provide the gate scanning signal GO_S1 (*n*) and the driving voltage GO_ELVDD (n) to the pixel, while the driving control unit arranged on the right can provide the driving control signal GO_S2 (*n*) to the pixel. By adjusting the start signals and clock signals for the left and right portions, it is able to compensate for the threshold of the pixel and drive the pixel.

Figure 2:
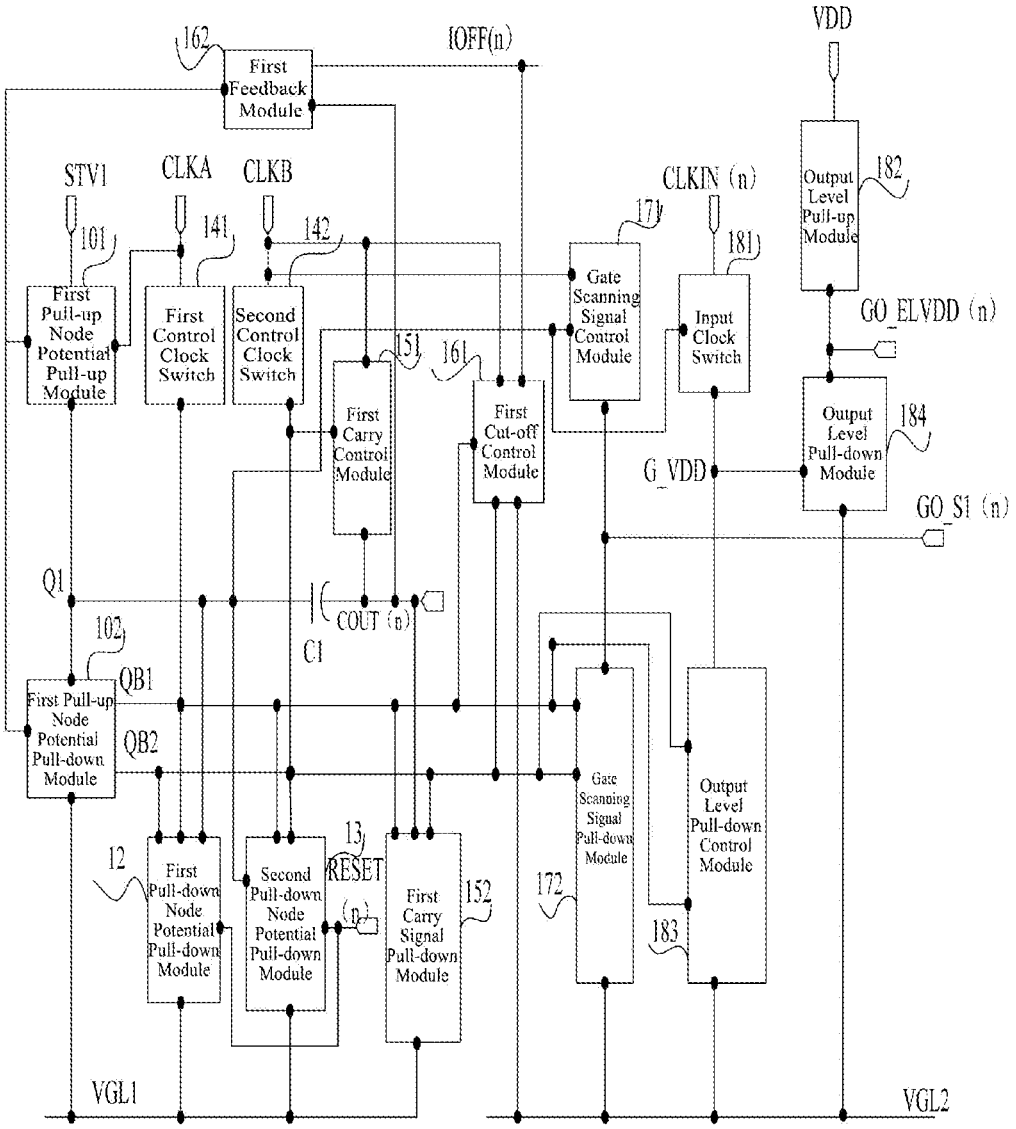
FIG. 2 is a block diagram showing a structure of the pixel driving unit of the gate driver circuit according to one embodiment of the present disclosure.

As shown in FIG. 2, in the gate driver circuit of the present disclosure, the row pixel controlling unit includes a first start signal input end STV1, a first control clock input end CLKA, a second control clock input end CLKB, a reset signal input end RESET (n), an input clock end CLKIN (n), a carry signal output end COUT (n), a cut-off control signal output end IOFF (n), an output level end GO_ELVDD (n), an output level pull-down control end G_VDD, a gate scanning signal output end GO_S1 (*n*).

The row pixel controlling unit further includes:

a first pull-up node potential pull-up module 101 configured to pull up a potential of a first pull-up node Q1 to a high level when a first control clock signal and a first start signal are at a high level;

a first storage capacitor C connected between the first pull-up node Q1 and the carry signal output end COUT (n);

a first pull-up node potential pull-down module 102 configured to pull down the potential of the first pull-up mode Q1 to a first low level VGL1 when a potential of a first pull-down node QB1 or a second pull-down node QB2 is a high level;

a first control clock switch 141 configured to enable the first control clock input end CLKA to be electrically connected to the first pull-down node QB1 when the first control clock signal is at a high level;

a second control clock switch 142 configured to enable the second control clock input end CLKB to be electrically connected to the second pull-down node QB2 when a second control clock signal is at a high level;

a first pull-down node potential pull-down module 12 configured to pull down the potential of the first pull-down node QB1 to the first low level VGL1 when the potential of the first pull-up node Q1 or the second pull-down node QB2 is a high level;

a second pull-down node potential pull-down module 13 connected to the reset signal input end RESET (n) and configured to pull down the potential of the second pull-down node QB2 to the first low level VGL1 when the potential of the first pull-up node Q1 or the first pull-down node QB1 is a high level;

a first carry control module 151 configured to enable the carry signal output end COUT (n) to be electrically connected to the second clock signal input end CLKB when the potential of the first pull-up node Q1 is a high level;

a first carry signal pull-down module 152 configured to pull down a potential of a carry signal to the first low level VGL1 when the potential of the first pull-down node QB1 or the second pull-down node QB2 is a high level;

a first cut-off control module 161 configured to enable the second clock signal input end CLKB to be electrically connected to the cut-off control signal output end IOFF (n) when the potential of the first pull-up node Q1 is a high level, and enable the cut-off control signal output end IOFF (n) to be electrically connected to a second low level output end VGL2 when the potential of the first pull-down node QB1 or the second pull-down node QB2 is a high level;

a first feedback module 162 configured to transmit a cut-off control signal to the first pull-up node potential pull-up module 101 and the first pull-up node potential pull-down module 102 when the carry signal is at a high level;

a gate scanning signal control module 171 configured to enable the second control clock input end CLKB to be electrically connected to the gate scanning signal output end GO_S1 (*n*) when the potential of the first pull-up node Q1 is a high level;

an input clock switch 181 configured to enable the input clock end CLKIN (n) to be electrically connected to the output level pull-down control end G_VDD when the potential of the first pull-up node Q1 is a high level;

a gate scanning signal pull-down module 172 configured to pull down a potential of the gate scanning signal to a second low level VGL2 when the potential of the first pull-down node QB1 or the second pull-down node QB2 is a high level;

an output level pull-up module 182 configured to pull up an output level to a high level when the output level pull-down control end G_VDD outputs the second low level VGL2;

an output level pull-down control module 183 configured to pull down a potential of the output level pull-down control end G_VDD to the second low level VGL2 when the potential of the first pull-down node QB1 or the second pull-down node QB2 is a high level; and an output level pull-down module 184 configured to pull down the output level to the second low level VGL2 when the output level pull-down control end G_VDD outputs a high level.

The row pixel controlling unit of the gate driver circuit in this embodiment includes two pull-down nodes, i.e., the first pull-down node QB1 and the second pull-down node QB2, so as to pull down the output. During a non-output period, the first pull-down node QB1 and the second pull-down node QB2 are alternating and complementary to each other. As a result, it is able to reduce a threshold voltage shift and prevent the occurrence of a time interval when pulling down the output, thereby to improve the stability and reliability.

During the operation of the row pixel controlling unit of the gate driver circuit in this embodiment, it is able to compensate for the pixel threshold voltage by adjusting the first start signal, the first control clock signal, the second control clock signal and the input clock signal.

The transistor used in all the embodiments of the present disclosure may be a TFT or FET, or any other device having the same characteristics. In the embodiments of the present disclosure, in order to differentiate two electrodes of the transistor except a gate electrode, one of the electrodes is called as a source electrode, and the other is called as a drain electrode. In addition, the transistor may be an N-type or P-type transistor on the basis of its characteristics. It is readily conceivable for a person skilled in the art, without any creative effort, to implement the driver circuit of the present disclosure with the N-type or P-type transistors, and it also falls within the scope of the present disclosure.

In the driver circuit of the present disclosure, a first electrode of the N-type transistor may be a source electrode, and a second electrode thereof may be a drain electrode. A first electrode of the P-type transistor may be a drain electrode, and a second electrode thereof may be a source electrode.

Figure 3:
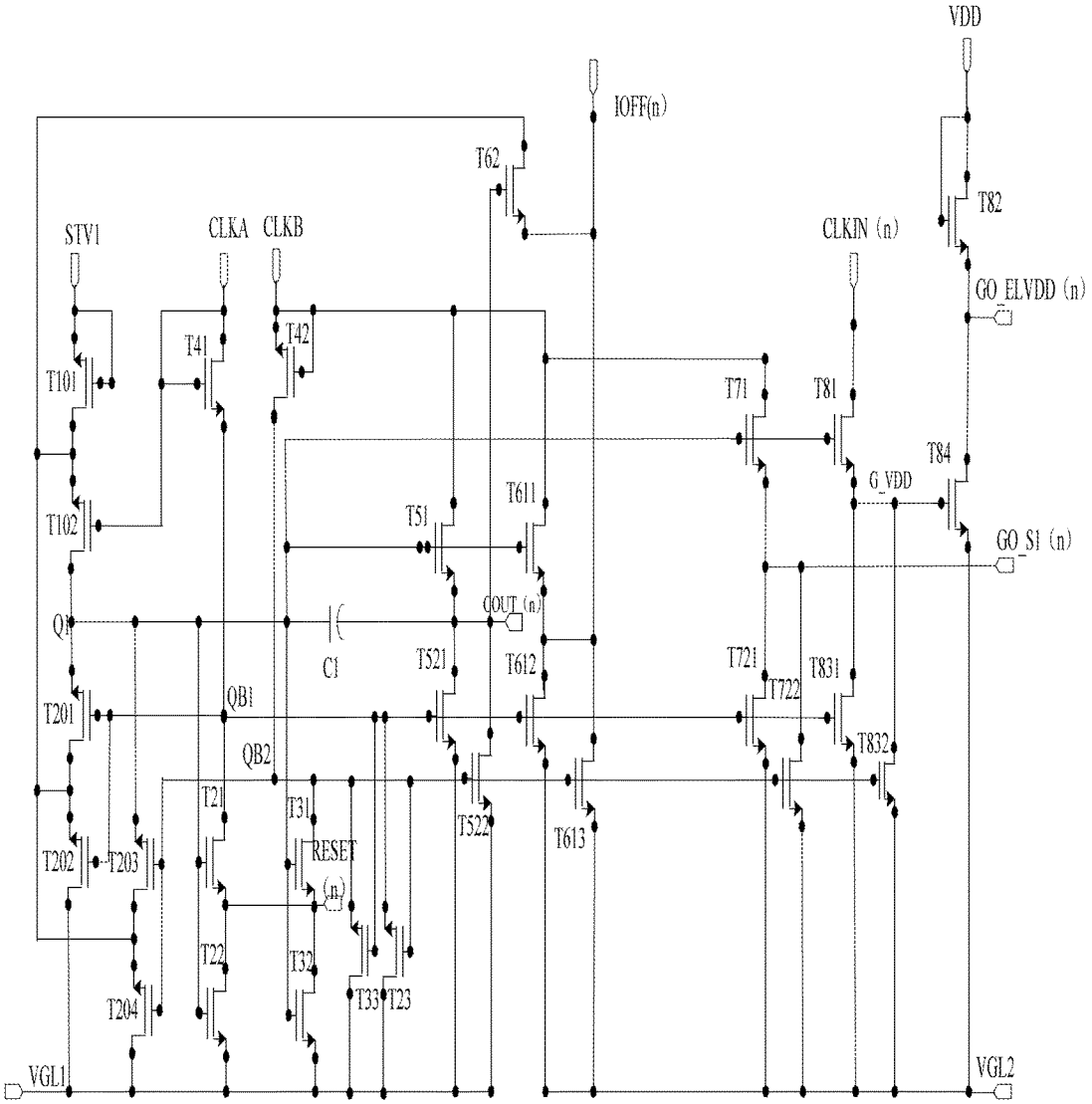
FIG. 3 is a circuit diagram of the pixel driving unit of the gate driver circuit according to one embodiment of the present disclosure.

To be specific, as shown in FIG. 3, the first pull-up node potential pull-up module 101 of the gate driver circuit includes:

- a first pull-up node potential pull-up transistor T101, a gate electrode and a first electrode of which are connected to the first start signal input end STV1, and a second electrode of which is connected to the first feedback module 162; and
- a second pull-up node potential pull-up transistor T102, a gate electrode of which is connected to the first control clock input end CLKA, a first electrode of which is connected to the second electrode of the first pull-up node potential pull-up transistor T101, and a second electrode of which is connected to the first pull-up node Q1.

The pull-up node potential pull-down module 102 includes:

- a first pull-up node potential pull-down transistor T201, a gate electrode of which is connected to the first pull-down node QB1, a first electrode of which is connected to the first pull-up node Q1, and a second electrode of which is connected to the first feedback module 162;
- a second pull-up node potential pull-down transistor T202, a gate electrode of which is connected to the first pull-down node QB1, a first electrode of which is connected to the second electrode of the first pull-up node potential pull-down transistor T201, and a second electrode of which is connected to the first low level VGL1;
- a third pull-up node potential pull-down transistor T203, a gate electrode of which is connected to the second pull-down node QB2, a first electrode of which is connected to the first pull-up node Q1, and a second electrode of which is connected to the first feedback module 162; and
- a fourth pull-up node potential pull-down transistor T204, a gate electrode of which is connected to the second pull-down node QB2, a first electrode of which is connected to the second electrode of the third pull-up node potential pull-down transistor T203, and a second electrode of which is connected to the first low level VGL1.

The first pull-down node potential pull-down module 12 includes:

- a first pull-down transistor T21, a gate electrode of which is connected to the first pull-down node Q1, a first electrode of which is connected to the first pull-down node QB1, and a second electrode of which is connected to the reset signal input end RESET (n);
- a second pull-down transistor T22, a gate electrode of which is connected to the first pull-up node Q1, a first electrode of which is connected to the second electrode of the first pull-down transistor T21, and a second electrode of which is connected to the first low level VGL1; and
- a third pull-down transistor T23, a gate electrode of which is connected to the second pull-down node QB2, a first electrode of which is connected to the first pull-down node QB1, and a second electrode of which is connected to the first low level VGL1.

The second pull-down node potential pull-down module 13 includes:

- a fourth pull-down transistor T31, a gate electrode of which is connected to the first pull-up node Q1, a first electrode of which is connected to the second pull-down node QB2, and a second electrode of which is connected to the reset signal input end RESET (n);

a fifth pull-down transistor T32, a gate electrode of which is connected to the first pull-up node Q1, a first electrode of which is connected to the second electrode of the fourth pull-down transistor T31, and a second electrode of which is connected to the first low level VGL1; and

- a sixth pull-down transistor T33, a gate electrode of which is connected to the first pull-down node QB1, a first electrode of which is connected to the second pull-down node QB2, and a second electrode of which is connected to the first low level VGL1.

Referring to FIGS. 2 and 3, the carry control module 151 includes:

- a carry control transistor T51, a gate electrode of which is connected to the first pull-up node Q1, a first electrode of which is connected to the second control clock input end CLKB, and a second electrode of which is connected to the carry signal output end COUT (n).

The carry signal pull-down module 152 includes:

- a first carry signal pull-down transistor T521, a gate electrode of which is connected to the first pull-down node QB1, a first electrode of which is connected to the carry signal output end COUT (n), and a second electrode of which is connected to the first low level VGL1; and
- a second carry signal pull-down transistor T522, a gate electrode of which is connected to the second pull-down node QB2, a first electrode of which is connected to the carry signal output end COUT (n), and a second electrode of which is connected to the first low level VGL1.

The first cut-off control module 161 includes:

- a first cut-off control transistor T611, a gate electrode of which is connected to the first pull-up node Q1, a first electrode of which is connected to the second control clock input end CLKB, and a second electrode of which is connected to the cut-off control signal output end IOFF (n);
- a second cut-off control transistor T612, a gate electrode of which is connected to the first pull-down node QB1, a first electrode of which is connected to the cut-off control signal output end IOFF (n), and a second electrode of which is connected to the first low level VGL1; and a third cut-off control transistor T613, a gate electrode of which is connected to the second pull-down node QB2, a first electrode of which is connected to the cut-off control signal output end IOFF (n), and a second electrode of which is connected to the first low level VGL1.

The first feedback module 162 includes:

a first feedback transistor T62, a gate electrode of which is connected to the first carry signal output end COUT (n), a first electrode of which is connected to the second electrode of the first pull-up node potential pull-up transistor T101, and a second electrode of which is connected to the cut-off control signal output end IOFF (n).

As shown in FIG. 3, the gate scanning signal control module 171 includes:

a gate scanning control transistor T71, a gate electrode of which is connected to the first pull-up node Q1, a first electrode of which is connected to the second control clock signal CLKB, and a second electrode of which is connected to the gate scanning signal output end GO_S1 (*n*).

The gate scanning signal pull-down module 172 includes:

a first output pull-down transistor T721, a gate electrode of which is connected to the first pull-down node QB1, a first electrode of which is connected to the gate scanning signal output end GO_S1 (*n*), and a second electrode of which is connected to the second low level VGL2; and a second output pull-down transistor T722, a gate electrode of which is connected to the second pull-down node QB2, a first electrode of which is connected to the gate scanning signal output end GO_S1 (*n*), and a second electrode of which is connected to the second low level VGL2.

The input clock switch 181 includes an input transistor T81, a gate electrode of which is connected to the first pull-up node Q1, a first electrode of which is connected to CLKIN (n), and a second electrode of which is connected to G_VDD.

The output level pull-up module 182 includes an output level pull-up transistor T82, a gate electrode and a first electrode of which are connected to the high level VDD, and a second electrode of which is connected to the output level end GO_ELVDD (n).

The output level pull-down control module 183 includes:

a first pull-down control transistor T831, a gate electrode of which is connected to the first pull-down node QB1, a first electrode of which is connected to the output level pull-down control end G_VDD, and a second electrode of which is connected to the second low level VGL2; and a second pull-down control transistor T832, a gate electrode of which is connected to the second pull-down node QB2, a first electrode of which is connected to the output level pull-down control end G_VDD, and a second electrode of which is connected to the second low level VGL2.

The output level pull-down module 184 includes:

an output level pull-down transistor T84, a gate electrode of which is connected to the output level pull-down control end G_VDD, a first electrode of which is connected to the output level end GO_ELVDD (n), and a second electrode of which is connected to the second low level VGL2.

During the implementation, the first control clock signal is complementary to the second control clock signal.

As shown in FIG. 3, the first control clock switch 141 includes a first control transistor T41, a gate electrode and a first electrode of which are connected to CLKA, and a second electrode of which is connected to QB1. The second control clock switch 142 includes a second control transistor T42, a gate electrode and a first electrode of which are connected to CLKB, and a second electrode of which is connected to QB2. The first storage capacitor C1 is connected between Q and COUT (n).

In the embodiment as shown in FIG. 3, T101, T102, T42, T201, T202, T203 and T204 are P-type transistors, while T21, T22, T31, T32, T41, T51, T521, T522, T611, T612, T613, T62, T71, T721, T722, T81, T82, T831, T832 and T84 are N-type transistors. In the other embodiments, various transistors may be adopted, as long as they can achieve the same control effects of turning on and turning off.

Figure 4:
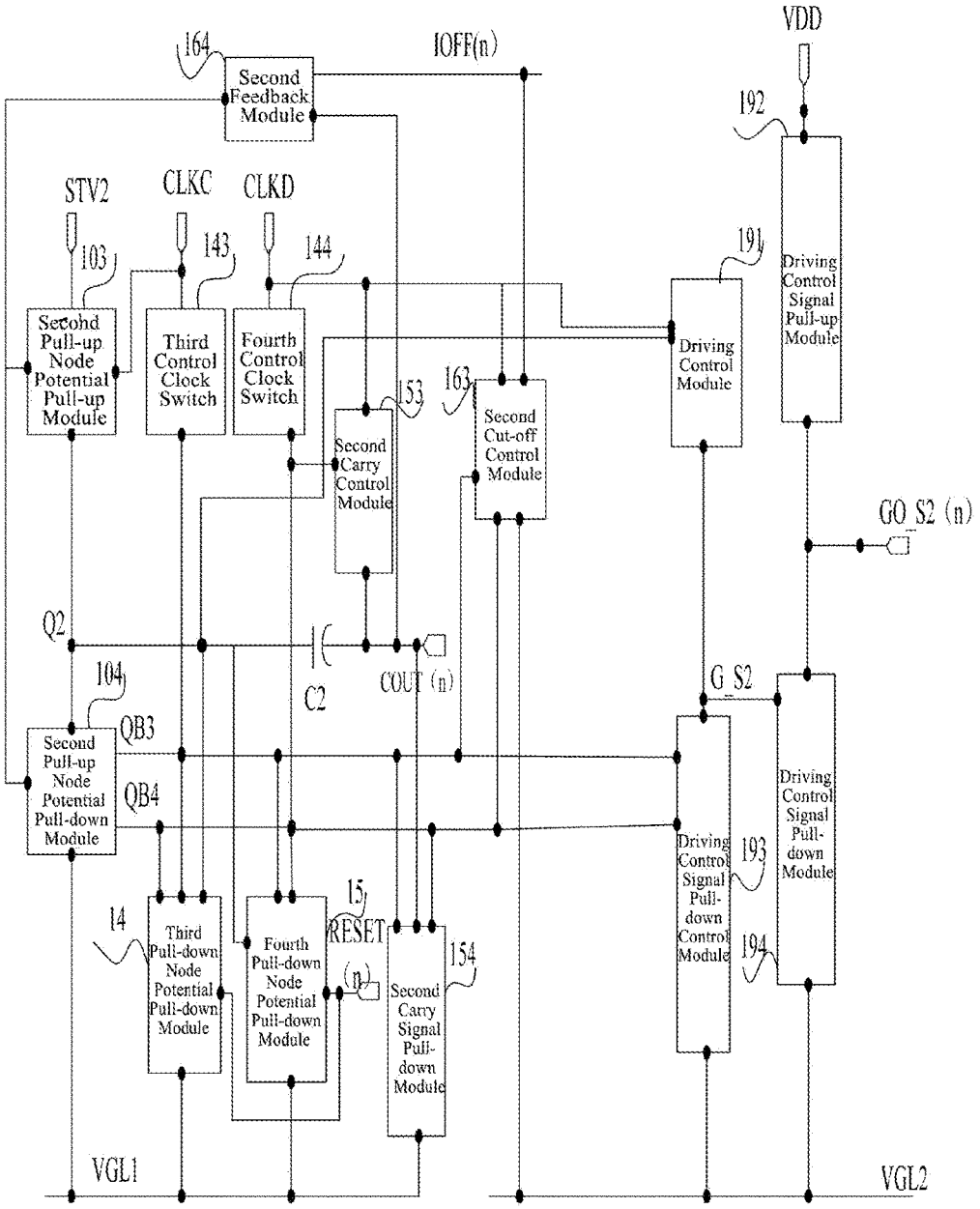
FIG. 4 is a block diagram showing a structure of a driving control unit of the gate driver circuit according to one embodiment of the present disclosure.

As shown in FIG. 4, the driving control unit includes a second start signal input end STV2, a third control clock input end CLKC, a fourth control clock input end CLKD, a driving control signal output end GO_S2 (*n*) and a driving control signal pull-down control end G_S2. The driving control unit is connected to the reset signal input end RESET (n), the carry signal output end COUT (n) and the cut-off control signal output end IOFF (n), respectively.

The driving control unit further includes:

a second pull-up node potential pull-up module 103 configured to pull up a potential of a second pull-up node Q2 to a high level when a third control clock signal and a second start signal are at a high level;

a second storage capacitor C2 connected between the second pull-up node Q2 and the carry signal output end COUT (n);

a fourth pull-up node potential pull-down module 104 configured to pull down the potential of the second pull-up node Q2 to the first low level VGL1 when a potential of a third pull-down node QB3 or a fourth pull-down node QB4 is a high level;

a third control clock switch 143 configured to enable the third control clock input end CLKC to be electrically connected to the third pull-down node QB3 when the third control clock signal is at a high level;

a fourth control clock switch 144 configured to enable the fourth control clock input end CLKD to be electrically connected to the fourth pull-down node QB4 when a fourth control clock signal is at a high level;

a third pull-down node potential pull-down module 14 configured to pull down the potential of the third pull-down node QB3 to the first low level VGL1 when the potential of the second pull-up node Q2 or the fourth pull-down node QB4 is a high level;

a fourth pull-down node potential pull-down module 15 connected to the reset signal input end RESET (n) and configured to pull down the potential of the fourth pull-down node QB4 to the first low level VGL1 when the potential of the second pull-up node Q2 or the third pull-down node QB3 is a high level;

a second carry control module 153 configured to enable the carry signal output end COUT (n) to be electrically connected to the fourth clock signal input end CLKD when the potential of the second pull-up node Q2 is a high level;

a second carry signal pull-down module 154 configured to pull down the potential of the carry signal to the first low level VGL1 when the potential of the third pull-down node QB3 or the fourth pull-down node QB4 is a high level;

a second cut-off control module 163 configured to enable the fourth clock signal input end CLKD to be electrically connected to the cut-off control signal output end IOFF (n) when the potential of the second pull-up node Q2 is a high level, and enable the cut-off control signal output end IOFF (n) to be electrically connected to the second low level output end when the potential of the first pull-down node QB1 or the second pull-down node QB2 is a high level, the second low level output end outputting the second low level VGL2;

a second feedback module 164 configured to transmit the cut-off control signal to a second pull-up node potential pull-up module 103 and the second pull-up node potential pull-down module 104 when the carry signal is at a high level;

a driving control submodule 191 configured to enable the fourth control clock input end CLKD to be electrically connected to the driving control signal pull-down control end G_S2 when the potential of the second pull-up node Q2 is a high level;

a driving control signal pull-up module 192 configured to pull up the potential of the driving control signal to the high level VDD when the driving control signal pull-down control end G_S2 outputs a high level;

a driving control signal pull-down control module 193 configured to pull down a potential of the driving control signal pull-down control end G_S2 to the second low level VGL2 when the potential of the third pull-down node QB3 or the fourth pull-down node QB4 is a high level; and a driving control signal pull-down module 194 configured to pull down the potential of the driving control signal to the second low level VGL2 when the driving control signal pull-down control end G_S2 outputs a high level.

The driving control unit of the gate driver circuit in this embodiment includes two pull-down nodes, i.e., the third pull-down node QB3 and the fourth pull-down node QB4, so as to pull down the output. During a non-output period, the third pull-down node QB3 and the fourth pull-down node QB4 are alternating and complementary to each other. As a result, it is able to reduce a threshold voltage shift and prevent the occurrence of a time interval when pulling down the output, thereby to improve the stability and reliability.

During the operation of the gate driving unit of the gate driver circuit in this embodiment, it is able to drive the pixel by adjusting the second start signal, the third control clock signal and the fourth control clock signal.

Here, the types of the transistors used in all the embodiments of the present disclosure are not particularly defined. In other words, the transistor may be a TFT or FET, or any other device having the same characteristics. In the embodiments of the present disclosure, in order to differentiate two electrodes of the transistor except a gate electrode, one of the electrodes is called as a source electrode, and the other is called as a drain electrode. In addition, the transistor may be an N-type or P-type transistor on the basis of its characteristics. It is readily conceivable for a person skilled in the art, without any creative effort, to implement the driver circuit of the present disclosure with the N-type or P-type transistors, and it also falls within the scope of the present disclosure.

In the driver circuit of the present disclosure, a first electrode of the N-type transistor may be a source electrode, and a second electrode thereof may be a drain electrode. A first electrode of the P-type transistor may be a drain electrode, and a second electrode thereof may be a source electrode.

Figure 5:
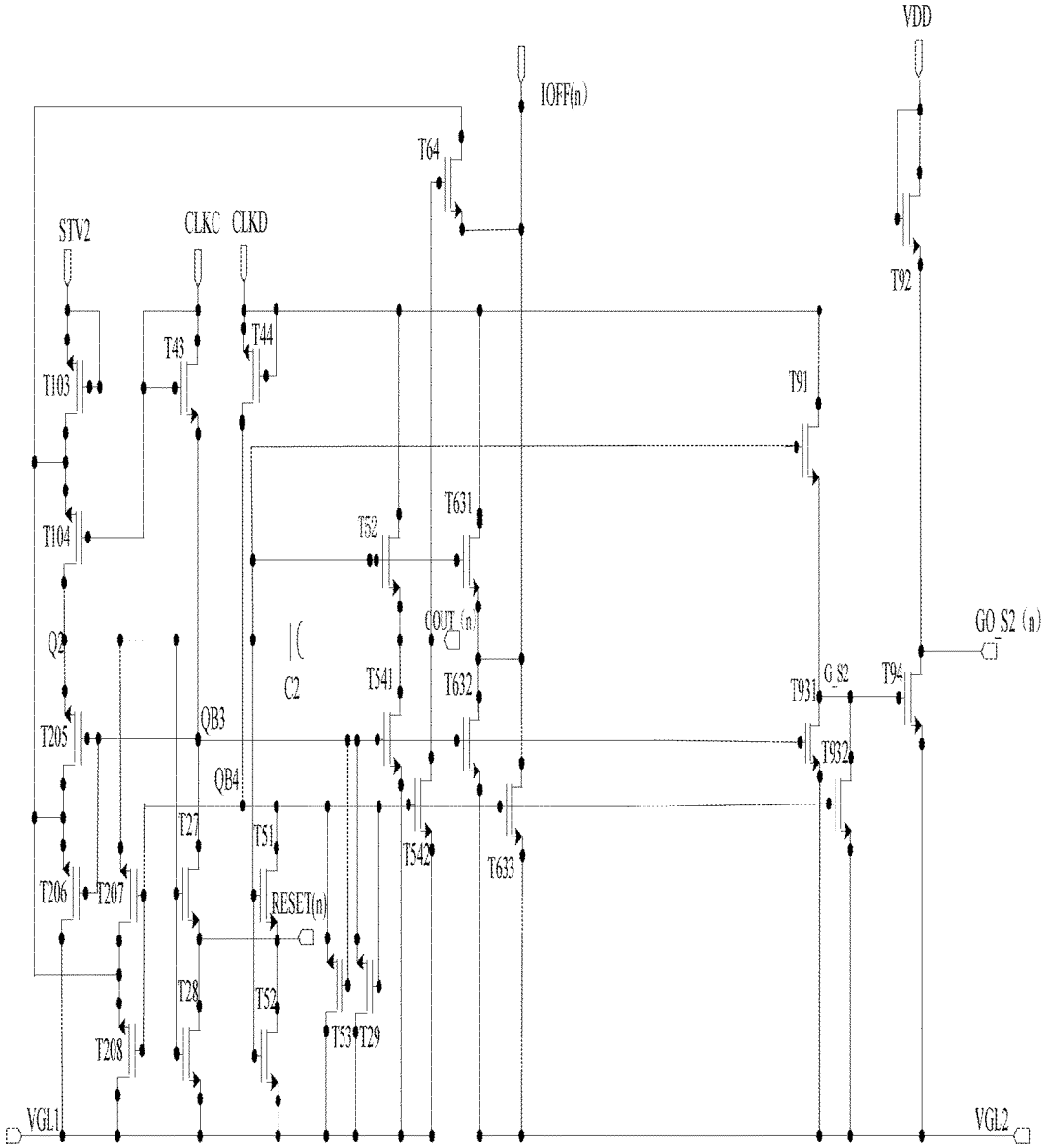
FIG. 5 is a circuit diagram of the driving control unit of the gate driver circuit according to one embodiment of the present disclosure.

To be specific, as shown in FIG. 5, in the driving control unit of the gate driver circuit in this embodiment, the second pull-up node potential pull-up module 103 includes:

a third pull-up node potential pull-up transistor T103, a gate electrode and a first electrode of which are connected to the second start signal input end STV2, and a second electrode of which is connected to the second feedback module 164; and a fourth pull-up node potential pull-up transistor T104, a gate electrode of which is connected to the third control clock input end CLKC, a first electrode of which is connected to the second electrode of the third pull-up node potential pull-up transistor T103, and a second electrode of which is connected to the second pull-up node Q2.

The second pull-up node potential pull-down module 104 includes:

a fifth pull-up node potential pull-down transistor T205, a gate electrode of which is connected to the third pull-down node QB3, a first electrode of which is connected to the second pull-up node Q2, and a second electrode of which is connected to the second feedback module 164;

a sixth pull-up node potential pull-down transistor T206, a gate electrode of which is connected to the third pull-down node QB3, a first electrode of which is connected to the second electrode of the third pull-up node potential pull-down transistor T203, and a second electrode of which is connected to the first low level VGL1;

a seventh pull-up node potential pull-down transistor T207, a gate electrode of which is connected to the fourth pull-down node QB4, a first electrode of which is connected to the second pull-up node Q2, and a second electrode of which is connected to the second feedback module 164; and an eighth pull-up node potential pull-down transistor T208, a gate electrode of which is connected to the fourth pull-down node QB4, a first electrode of which is connected to the second electrode of the seventh pull-up node potential pull-down transistor T207, and a second electrode of which is connected to the first low level VGL1.

The third pull-down node potential pull-down module 14 includes:

a seventh pull-down transistor T27, a gate electrode of which is connected to the second pull-up node Q2, a first electrode of which is connected to the third pull-down node QB3, and a second electrode of which is connected to the reset signal input end RESET (n);

an eighth pull-down transistor T28, a gate electrode of which is connected to the second pull-up node Q2, a first electrode of which is connected to the second electrode of the seventh pull-down transistor T27, and a second electrode of which is connected to the first low level VGL1; and a ninth pull-down transistor T29, a gate electrode of which is connected to the third pull-down node QB4, a first electrode of which is connected to the third pull-down node QB3, and a second electrode of which is connected to the first low level VGL1.

The fourth pull-down node potential pull-down module 15 includes:

a tenth pull-down transistor T51, a gate electrode of which is connected to the second pull-up node Q2, a first electrode of which is connected to the second pull-down node QB2, and a second electrode of which is connected to the carry signal input end RESET (n);

an eleventh pull-down transistor T52, a gate electrode of which is connected to the second pull-up node Q2, a first electrode of which is connected to the second electrode of the fourth pull-down transistor T31, and a second electrode of which is connected to the first low level VGL1; and a twelfth pull-down transistor T53, a gate electrode of which is connected to the third pull-down node QB3, a first electrode of which is connected to the fourth pull-down node QB4, and a second electrode of which is connected to the first low level VGL1.

As shown in FIG. 5, the second carry control module 153 includes:

a second carry control transistor T52, a gate electrode of which is connected to the second pull-up node Q2, a first electrode of which is connected to the fourth control clock input end CLKD, and a second electrode of which is connected to the carry signal output end COUT (n).

The second carry signal pull-down module 154 includes:

a third carry signal pull-down transistor T541, a gate electrode of which is connected to the third pull-down node QB3, a first electrode of which is connected to the carry signal output end COUT (n), and a second electrode of which is connected to the first low level VGL1; and a fourth carry signal pull-down transistor T542, a gate electrode of which is connected to the fourth pull-down node QB4, a first electrode of which is connected to the carry signal output end COUT (n), and a second electrode of which is connected to the first low level VGL1.

The second cut-off control module 163 includes:

a fourth cut-off control transistor T631, a gate electrode of which is connected to the second pull-up node Q2, a first electrode of which is connected to the fourth control clock input end CLKD, and a second electrode of which is connected to the cut-off control signal output end IOFF (n);

a fifth cut-off control transistor T632, a gate electrode of which is connected to the third pull-down node QB3, a first electrode of which is connected to the cut-off control signal output end IOFF (n), and a second electrode of which is connected to the first low level VGL1; and a sixth cut-off control transistor T633, a gate electrode of which is connected to the fourth pull-down node QB4, a first electrode of which is connected to the cut-off control signal output end IOFF (n), and a second electrode of which is connected to the first low level VGL1.

The second feedback module 164 includes:

a second feedback transistor T64, a gate electrode of which is connected to the carry signal output end COUT (n), a first electrode of which is connected to the second electrode of the third pull-up node potential pull-up transistor T103, and a second electrode of which is connected to the cut-off control signal output end IOFF (n).

As shown in FIG. 5, the driving control submodule 191 includes a driving control transistor T91, a gate electrode of which is connected to the second pull-up node Q2, a first electrode of which is connected to the fourth control clock input end CLKD, and a second electrode of which is connected to the driving control signal pull-down control end G_S2.

The second driving control signal pull-up module 192 includes:

a driving control pull-up transistor T92, a gate electrode and a first electrode of which are connected to the high level VDD, and a second electrode of which is connected to the driving control signal output end GO_S2 (*n*).

The driving control signal pull-down control module 193 includes:

a first driving pull-down control transistor T931, a gate electrode of which is connected to the third pull-down node QB3, a first electrode of which is connected to the driving control signal pull-down control end G_S2, and a second electrode of which is connected to the second low level VGL2; and a second driving pull-down control transistor T932, a gate electrode of which is connected to the fourth pull-down node QB4, a first electrode of which is connected to the driving control signal pull-down control end G_S2, and a second electrode of which is connected to the second low level VGL2.

The driving control signal pull-down module 194 includes:

a driving pull-down transistor T94, a gate electrode of which is connected to the driving control signal pull-down control end G_S2, a first electrode of which is connected to the driving control signal output end GO_S1 (*n*), and a second electrode of which is connected to the second low level VGL2.

During the implementation, the first control clock signal is complementary to the second control clock signal.

As shown in FIG. 5, the third control clock switch 143 includes a third control transistor T43, a gate electrode and a first electrode of which is connected to CLKC, and a second electrode of which is connected to QB3. The fourth control clock switch 144 includes a fourth control transistor T44, a gate electrode and a first electrode of which are connected to CLKD, and a second electrode of which is connected to QB4. The second storage capacitor C2 is connected between Q2 and COUT2 (*n*).

In the embodiment as shown in FIG. 5, T103, T104, T44, T205, T206, T207, T208, T53 and T29 are all P-type transistors, while T27, T28, T51, T52, T43, T52, T541, T542, T631, T632, T633, T64, T91, T92, T931, T932 and T94 are all N-type transistors. In the other embodiments, various transistors may be adopted, as long as they can achieve the same control effects of turning on and turning off.

Figure 6A:
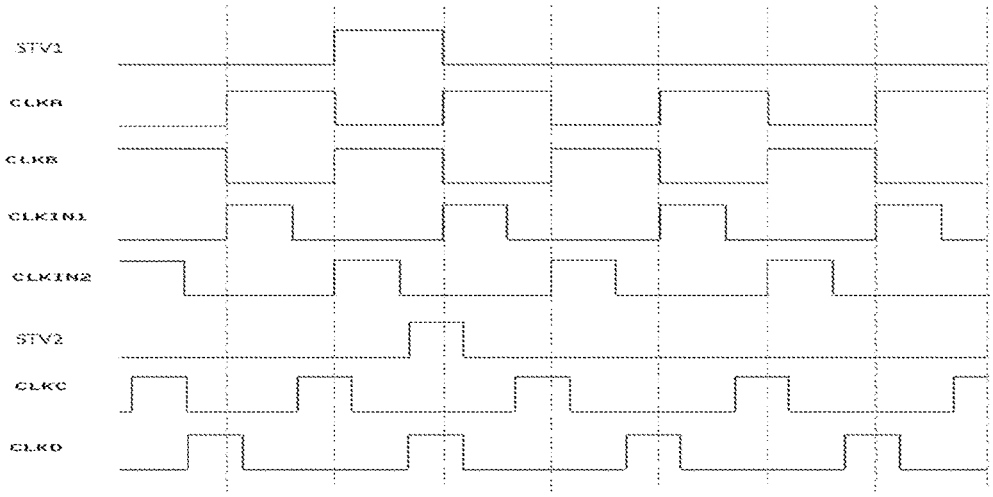
FIG. 6A is waveforms of a first start signal, a second start signal, a first control clock signal, a second control clock signal, an input clock signal inputted to an $n^{th}$-level gate driver circuit and an input clock signal inputted to an $(n+1)^{th}$-level gate driver circuit during the operation of a GOA circuit according to one embodiment of the present disclosure.

As shown in FIG. 6A, the first control clock signal inputted by CLKA is of a phase reverse to the second control clock signal inputted by CLKB, and duty ratios of the first control clock signal, the second control clock signal and the first start signal inputted by STV1 are all 0.5. The third control clock signal inputted by CLKC is of a phase reverse to the fourth control clock signal inputted by CLKD, and duty ratios of the third control clock signal, the fourth control clock signal and the second start signal inputted by STV1 are all less than 0.5.

Figure 6B:
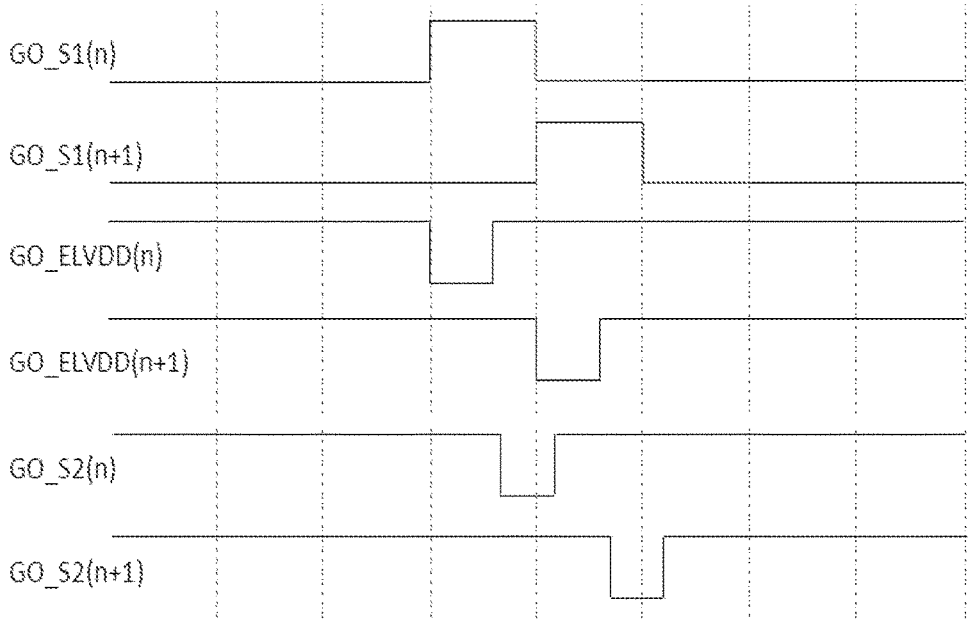
FIG. 6B is an operation sequence diagram of the GOA circuit according to one embodiment of the present disclosure.

As shown in FIG. 6B, the phase relationship between GO_S1 (*n*) and GO_S2 (*n*) is identical to that between S1 and S2 in FIG. 1C.

The present disclosure further provides a gate driving method for use in the gate driver circuit, including the steps of:

within a clock cycle after a first start signal input end inputs a high level, outputting, by a gate scanning signal output end, a high level, and a phase of an output signal from an output level end being reverse to that of an input clock signal; and within a clock cycle after a second start signal input end inputs a high level, a phase of a driving control signal being reverse to that of a second start signal.

The present disclosure further provides a GOA circuit including multiple levels of the above-mentioned gate driver circuits. Apart from a first-level gate driver circuit, a cut-off control signal output end of each level of gate driver circuit is connected to a reset signal input end of a previous-level gate driver circuit, and apart from a last-level gate driver circuit, a carry signal output end of each level of gate driver circuit is connected to a first start signal input end of a next-level gate driver circuit.

During the implementation, the input clock signal CLKIN1 inputted to an $(n+1)^{th}$-level gate driver circuit is of a phase reverse to the input clock signal CLKIN2 inputted to an $n^{th}$-level gate driver circuit. N is an integer greater than or equal to 1, and (n+1) is less than or equal to the number of levels of the gate driver circuits included in the GOA circuit.

FIG. 6A is waveforms of STV1, STV2, CLKA, CLKB, CLKC, CLKD, CLKIN1 and CLKIN2 during the operation of the gate driver circuit according to one embodiment of the present disclosure, and FIG. 6B is waveforms of GO_S1 (*n*), GO_S1 (*n*+1), GO_ELVDD (n), GO_ELVDD (n+1), GO_S2 (*n*) and GO_S2 (*n*+1) outputted by the GOA circuit according to one embodiment of the present disclosure.

In the GOA circuit of the present disclosure, the carry signal outputted from a previous-level gate driver circuit is connected to the first start signal input end of an adjacent next-level gate driver circuit. Hence, the control clock signals are inputted to the row pixel controlling unit and the driving control unit of each level of gate driver circuit, respectively, so as to pull up the carry signal to a high level through the control clock signal for controlling the row pixel controlling unit and the control clock signal for controlling the driving control unit, thereby to increase a pre-charge time for the storage capacitors. The gate driver circuit of the present disclosure may be applied to an OLED display device or an LTPS display device.

The present disclosure further provides a display device including the above-mentioned gate driver circuit. The display device may be an OLED or LTPS display device.

The present disclosure further provides an electronic product including the above-mentioned display device. The structure and the operational principle of the display device included in the electronic product are identical to those mentioned in the above embodiments, and they will not be repeated herein. In addition, the structures of the other components of the electronic product may refer to those mentioned in the prior art, and they will not be particularly defined herein. The electronic product may be any product or member having a display function, such as household appliance, communication facility, engineering facility and electronic entertainment product.

The above are merely the preferred embodiments of the present disclosure. It should be noted that, a person skilled in the art may make further improvements and modifications without departing from the principle of the present disclosure, and these improvements and modifications shall also fall within the scope of the present disclosure.

What is claimed is:

1. A gate driver circuit, connected to a row of pixel units, each pixel unit includes a pixel driving module and a light-emitting device connected to each other, the pixel driving module including a driving transistor, a driving module and a compensating module, the compensating module being connected to a gate scanning signal, and the driving module being connected to a driving control signal and a driving voltage, the gate driver circuit comprising:

a row pixel controlling unit configured to provide the gate scanning signal to the compensating module and provide the driving voltage to the driving module, so as to control the compensating module to compensate for a threshold voltage of the driving transistor;

a driving control unit configured to provide the driving control signal to the driving module so as to control the driving module to drive the light-emitting device, wherein the row pixel controlling unit comprises a first start signal input end, a first control clock input end, a second control clock input end, a reset signal input end, an input clock end, a carry signal output end, a cut-off control signal output end, an output level end, an output level pull-down control end, a gate scanning signal output end, a first pull-up node potential pull-up module configured to pull up a potential of a first pull-up node to a high level when a first control clock signal and a first start signal are at a high level, a first storage capacitor connected between the first pull-up node and the carry signal output end, a first pull-up node potential pull-down module configured to pull down the potential of the first pull-up module to a first low level when a potential of a first pull-down node or a second pull-down node is a high level, a first control clock switch configured to enable the first control clock input end to be electrically connected to the first pull-down node when the first control clock signal is at a high level, a second control clock switch configured to enable the second control clock input end to be electrically connected to the second pull-down node when a second control clock signal is at a high level, a first pull-down node potential pull-down module configured to pull down the potential of the first pull-down node to the first low level when the potential of the first pull-up node or the second pull-down node is a high level, and a second pull-down node potential pull-down module connected to the reset signal input end and configured to pull down the potential of the second pull-down node to the first low level when the potential of the first pull-up node or the first pull-down node is a high level, a first carry control module configured to enable the carry signal output end to be electrically connected to the second control clock input end when the potential of the first pull-up node is a high level;

a first carry signal pull-down module configured to pull down a potential of a carry signal to the first low level when the potential of the first pull-down node or the second pull-down node is a high level;

a first cut-off control module configured to enable the second control clock input end to be electrically connected to the cut-off control signal output end when the potential of the first pull-up node is a high level, and enable the cut-off control signal output end to be electrically connected to a second low level output end when the potential of the first pull-down node or the second pull-down node is a high level;

a first feedback module configured to transmit a cut-off control signal to the first pull-up node potential pull-up module and the first pull-up node potential pull-down module when the carry signal is at a high level;

a gate scanning signal control module configured to enable the second control clock input end to be electrically connected to the gate scanning signal output end when the potential of the first pull-up node is a high level;

an input clock switch configured to enable the input clock end to be electrically connected to the output level pull-down control end when the potential of the first pull-up node is a high level;

a gate scanning signal pull-down module configured to pull down a potential of the gate scanning signal to a second low level when the potential of the first pull-down node or the second pull-down node is a high level;

an output level pull-down control module configured to pull down a potential of the output level pull-down control end to the second low level when the potential of the first pull-down node or the second pull-down node is a high level;

an output level pull-up module configured to pull up an output level to a high level when the output level pull-down control end outputs the second low level; and an output level pull-down module configured to pull down the output level to the second low level when the output level pull-down control end outputs a high level.

2. The gate driver circuit according to claim 1, wherein:

the driving control unit comprises a second start signal input end, a third control clock input end, a fourth control clock input end, a driving control signal output end, and a driving control signal pull-down control end;

the reset signal input end, the carry signal output end and the cut-off control signal output end are connected to the driving control unit; and the driving control unit further comprises a second pull-up node potential pull-up module configured to pull up a potential of a second pull-up node to a high level when a third control clock signal and a second start signal are at a high level, a second storage capacitor connected between the second pull-up node and the carry signal output end, a second pull-up node potential pull-down module configured to pull down the potential of the second pull-up node to the first low level when the potential of the first pull-down node or the second pull-down node is a high level, a third control clock switch configured to enable the third control clock input end to be electrically connected to a third pull-down node when the third control clock signal is at a high level, a fourth control clock switch configured to enable the fourth control clock input end to be electrically connected to a fourth pull-down node when a fourth control clock signal is at a high level, a third pull-down node potential pull-down module configured to pull down a potential of the third pull-down node to the first low level when the potential of the second pull-up node or a potential of the fourth pull-down node is a high level, a fourth pull-down node potential pull-down module connected to the reset signal input end and configured to pull down the potential of the fourth pull-down node to the first low level when the potential of the second pull-up node or the third pull-down node is a high level, a second carry control module configured to enable the carry signal output end to be electrically connected to the fourth control clock input end when the potential of the second pull-up node is a high level, a second carry signal pull-down module configured to pull down the potential of the carry signal to the first low level when the potential of the third pull-down node or the fourth pull-down node is a high level, a second cut-off control module configured to enable the fourth control clock input end to be electrically connected to the cut-off control signal output end when the potential of the second pull-up node is a high level, and enable the cut-off control signal output end to be electrically connected to the second low level output end when the potential of the third pull-down node or the fourth pull-down node is a high level, a second feedback module configured to transmit the cut-off control signal to the second pull-up node potential pull-up module and the second pull-up node potential pull-down module when the carry signal is at a high level, a driving control submodule configured to enable the fourth control clock input end to be electrically connected to the driving control signal pull-down control end when the potential of the second pull-up node is a high level, a driving control signal pull-down control module configured to pull down a potential of the driving control signal pull-down control end to the second low level when the potential of the third pull-down node or the fourth pull-down node is a high level, a driving control signal pull-up module configured to pull up a potential of the driving control signal to a high level when the driving control signal pull-down control end outputs a high level, and a driving control signal pull-down module configured to pull down the potential of the driving control signal to the second low level when the driving control signal pull-down control end outputs a high level.

3. The gate driver circuit according to claim 2, wherein:

the first pull-up node potential pull-up module comprises a first pull-up node potential pull-up transistor, a gate electrode and a first electrode of which are connected to the first start signal input end, and a second electrode of which is connected to the first feedback module, and a second pull-up node potential pull-up transistor, a gate electrode of which is connected to the first control clock input end, a first electrode of which is connected to the second electrode of the first pull-up node potential pull-up transistor, and a second electrode of which is connected to the first pull-up node;

the first pull-up node potential pull-down module comprises a first pull-up node potential pull-down transistor, a gate electrode of which is connected to the first pull-down node, a first electrode of which is connected to the first pull-up node, and a second electrode of which is connected to the first feedback module, a second pull-up node potential pull-down transistor, a gate electrode of which is connected to the first pull-down node, a first electrode of which is connected to the second electrode of the first pull-up node potential pull-down transistor, and a second electrode of which is connected to the first low level, a third pull-up node potential pull-down transistor, a gate electrode of which is connected to the second pull-down node, a first electrode of which is connected to the first pull-up node, and a second electrode of which is connected to the first feedback module, and a fourth pull-node potential pull-down transistor, a gate electrode of which is connected to the second pull-down node, a first electrode of which is connected to the second electrode of the third pull-up node potential pull-down transistor, and a second electrode of which is connected to the first low level;

the first pull-down node potential pull-down module comprises a first pull-down transistor, a gate electrode of which is connected to the first pull-up node, a first electrode of which is connected to the first pull-down node, and a second electrode of which is connected to the reset signal input end, a second pull-down transistor, a gate electrode of which is connected to the first pull-up node, a first electrode of which is connected to the second electrode of the first pull-down transistor, and a second electrode of which is connected to the first low level, and a third pull-down transistor, a gate electrode of which is connected to the second pull-down node, a first electrode of which is connected to the first pull-down node, and a second electrode of which is connected to the first low level; and the second pull-down node potential pull-down module comprises a fourth pull-down transistor, a gate electrode of which is connected to the first pull-up node, a first electrode of which is connected to the second pull-down node, and a second electrode of which is connected to the reset signal input end, a fifth pull-down transistor, a gate electrode of which is connected to the first pull-up node, a first electrode of which is connected to the second electrode of the fourth pull-down transistor, and a second electrode of which is connected to the first low level, and a sixth pull-down transistor, a gate electrode of which is connected to the first pull-down node, a first electrode of which is connected to the second pull-down node, and a second electrode of which is connected to the first low level.

4. The gate driver circuit according to claim 3, wherein:

the first carry control module comprises a first carry control transistor, a gate electrode of which is connected to the first pull-up node, a first electrode of which is connected to the second control clock input end, and a second electrode of which is connected to the carry signal output end;

the first carry signal pull-down module comprises a first carry signal pull-down transistor, a gate electrode of which is connected to the first pull-down node, a first electrode of which is connected to the carry signal output end, and a second electrode of which is connected to the first low level and a second carry signal pull-down transistor, a gate electrode of which is connected to the second pull-down node, a first electrode of which is connected to the carry signal output end, and a second electrode of which is connected to the first low level;

the first cut-off control module comprises a first cut-off control transistor, a gate electrode of which is connected to the first pull-up node, a first electrode of which is connected to the second control clock input end, and a second electrode of which is connected to the cut-off control signal output end, a second cut-off control transistor, a gate electrode of which is connected to the first pull-down node, a first electrode of which is connected to the cut-off control signal output end, and a second electrode of which is connected to the first low level, and a third cut-off control transistor, a gate electrode of which is connected to the second pull-down node, a first electrode of which is connected to the cut-off control signal output end, and a second electrode of which is connected to the first low level; and the first feedback module comprises a first feedback transistor, a gate electrode of which is connected to the carry signal output end, a first electrode of which is connected to the second electrode of the first pull-up node potential pull-up transistor, and a second electrode of which is connected to the cut-off control signal output end.

5. The gate driver circuit according to claim 4, wherein:

the gate scanning signal control module comprises a gate scanning control transistor, a gate electrode of which is connected to the first pull-up node, a first electrode of which is connected to the second control clock signal, and a second electrode of which is connected to the gate scanning signal output end;

the gate scanning signal pull-down module comprises a first output pull-down transistor, a gate electrode of which is connected to the first pull-down node, a first electrode of which is connected to the gate scanning signal output end, and a second electrode of which is connected to the second low level, and a second output pull-down transistor, a gate electrode of which is connected to the second pull-down node, a first electrode of which is connected to the gate scanning signal output end, and a second electrode of which is connected to the second low level;

the output level pull-up module comprises an output level pull-up transistor, a gate electrode and a first electrode of which are connected to a high level, and a second electrode of which is connected to the output level end;

the output level pull-down control module comprises a first pull-down control transistor, a gate electrode of which is connected to the first pull-down node, a first electrode of which is connected to the output level pull-down control end, and a second electrode of which is connected to the second low level, and a second pull-down control transistor, a gate electrode of which is connected to the second pull-down node, a first electrode of which is connected to the output level pull-down control end, and a second electrode of which is connected to the second low level; and the output level pull-down module comprises an output level pull-down transistor, a gate electrode of which is connected to the output level pull-down control end, a first electrode of which is connected to the output level end, and a second electrode of which is connected to the second low level.

6. The gate driver circuit according to claim 5, wherein:

the second pull-up node potential pull-up module comprises a third pull-up node potential pull-up transistor, a gate electrode and a first electrode of which are connected to the second start signal input end, and a second electrode of which is connected to the second feedback module, and a fourth pull-up node potential pull-up transistor, a gate electrode of which is connected to the third control clock input end, a first electrode of which is connected to the second electrode of the third pull-up node potential pull-up transistor, and a second electrode of which is connected to the second pull-up node;

the second pull-up node potential pull-down module comprises a fifth pull-up node potential pull-down transistor, a gate electrode of which is connected to the third pull-down node, a first electrode of which is connected to the second pull-up node, and a second electrode of which is connected to the second feedback module, a sixth pull-up node potential pull-down transistor, a gate electrode of which is connected to the third pull-down node, a first electrode of which is connected to the second electrode of the fifth pull-up node potential pull-down transistor, and a second electrode of which is connected to the first low level, a seventh pull-up node potential pull-down transistor, a gate electrode of which is connected to the fourth pull-down node, a first electrode of which is connected to the second pull-up node, and a second electrode of which is connected to the second feedback module, and an eighth pull-up node potential pull-down transistor, a gate electrode of which is connected to the fourth pull-down node, a first electrode of which is connected to the second electrode of the seventh pull-up node potential pull-down transistor, and a second electrode of which is connected to the first low level;

the third pull-down node potential pull-down module comprises a seventh pull-down transistor, a gate electrode of which is connected to the second pull-up node, a first electrode of which is connected to the third pull-down node, and a second electrode of which is connected to the reset signal input end, an eighth pull-down transistor, a gate electrode of which is connected to the second pull-up node, a first electrode of which is connected to the second electrode of the seventh pull-down transistor, and a second electrode of which is connected to the first low level, and a ninth pull-down transistor, a gate electrode of which is connected to the fourth pull-down node, a first electrode of which is connected to the third pull-down node, and a second electrode of which is connected to the first low level; and the fourth pull-down node potential pull-down module comprises a tenth pull-down transistor, a gate electrode of which is connected to the second pull-up node, a first electrode of which is connected to the fourth pull-down node, and a second electrode of which is connected to the reset signal input end, an eleventh pull-down transistor, a gate electrode of which is connected to the second pull-up node, a first electrode of which is connected to the second electrode of the tenth pull-down transistor, and a second electrode is connected to the first low level, and a twelfth pull-down transistor, a gate electrode of which is connected to the third pull-down node, a first electrode of which is connected to the fourth pull-down node, and a second electrode of which is connected to the first low level.

7. The gate driver circuit according to claim 6, wherein:

the second carry control module comprises a second carry control transistor, a gate electrode of which is connected to the second pull-up node, a first electrode of which is connected to the fourth control clock input end, and a second electrode of which is connected to the carry signal output end;

the second carry signal pull-down module comprises a third carry signal pull-down transistor, a gate electrode of which is connected to the third pull-down node, a first electrode of which is connected to the carry signal output end, and a second electrode of which is connected to the first low level, and a fourth carry signal pull-down transistor, a gate electrode of which is connected to the fourth pull-down node, a first electrode of which is connected to the carry signal output end, and a second electrode of which is connected to the first low level;

the second cut-off control module comprises a fourth cut-off control transistor, a gate electrode of which is connected to the second pull-up node, a first electrode of which is connected to the fourth control clock input end, and a second electrode of which is connected to the cut-off control signal output end, a fifth cut-off control transistor, a gate electrode of which is connected to the third pull-down node, a first electrode of which is connected to the cut-off control signal output end, and a second electrode of which is connected to the first low level, and a sixth cut-off control transistor, a gate electrode of which is connected to the fourth pull-down node, a first electrode of which is connected to the cut-off control signal output end, and a second electrode of which is connected to the first low level; and the second feedback module comprises a second feedback transistor, a gate electrode of which is connected to the carry signal output end, a first electrode of which is connected to the second electrode of the third pull-up node potential pull-up transistor, and a second electrode of which is connected to the cut-off control signal output end.

8. The gate driver circuit according to claim 7, wherein:

the driving control submodule includes a driving control transistor, a gate electrode of which is connected to the second pull-up node, a first electrode of which is connected to the fourth control clock input end, and a second electrode of which is connected to the driving control signal pull-down control end;

the driving control signal pull-up module comprises a driving control pull-up transistor, a gate electrode and a first electrode of which are connected to a high level, and a second electrode of which is connected to the driving control signal output end;

the driving control signal pull-down control module comprises a first driving pull-down control transistor, a gate electrode of which is connected to the third pull-down node, a first electrode of which is connected to the driving control signal pull-down control end, and a second electrode of which is connected to the second low level, and a second driving pull-down control transistor, a gate electrode of which is connected to the fourth pull-down node, a first electrode of which is connected to the driving control signal pull-down control end, and a second electrode of which is connected to the second low level; and the driving control signal pull-down module comprises a driving pull-down transistor, a gate electrode of which is connected to the driving control signal pull-down control end, a first electrode of which is connected to the driving control signal output end, and a second electrode of which is connected to the second low level.

9. The gate driver circuit according to claim 8, wherein:

the first control clock signal is of a phase reverse to a phase of the second control clock signal, and duty ratios of the first control clock signal, the second control clock signal and the first start signal are all 0.5; and the third control clock signal is of a phase reverse to a phase of the fourth control clock signal, and duty ratios of the third control clock signal, the fourth control clock signal and the second start signal are all less than 0.5.

10. A gate driving method for use in the gate driver circuit according to claim 2, comprising the steps of:

within a clock cycle after a first start signal input end inputs a high level, outputting, by a gate scanning signal output end, a high level, and a phase of an output signal from an output level end being reverse to a phase of an input clock signal; and within a clock cycle after a second start signal input end inputs a high level, a phase of a driving control signal being reverse to a phase of a second start signal.

11. A GOA circuit comprising multiple levels of the gate driver circuits according to claim 1, wherein:

apart from a first-level gate driver circuit, a cut-off control signal output end of each level of gate driver circuit is connected to a reset signal input end of a previous-level gate driver circuit; and apart from a last-level gate driver circuit, a carry signal output end of each level of gate driver circuit is connected to a first start signal input end of a next-level gate driver circuit.

12. The GOA circuit according to claim 11, wherein:

a input clock signal inputted to an $(n+1)^{th}$-level gate driver circuit is of a phase reverse to a phase of the input clock signal inputted to an $n^{th}$-level gate driver circuit;

n is an integer greater than or equal to 1; and (n+1) is less than or equal to the number of levels of the gate driver circuits included in the GOA circuit.

13. A display device comprising the gate driver circuit according to claim 1.

14. The display device according to claim 13, wherein the display device is an OLED display device or a low temperature poly-silicon (LTPS) display device.

15. An electronic device comprising the display device according to claim 13.

16. The electronic device according to claim 15, wherein the display device is an OLED display device or a low temperature poly-silicon (LTPS) display device.

* * * * *